US010772399B2

(12) United States Patent
Ritter et al.

(10) Patent No.: US 10,772,399 B2
(45) **Date of Patent: *Sep. 15, 2020**

(54) HINGED WALKING CANE

(71) Applicant: Medline Industries, Inc., Northfield, IL (US)

(72) Inventors: Joseph Ritter, Arlington Heights, IL (US); Megan Gilligan, Chicago, IL (US); Gregory J. Foster, Chicago, IL (US); Robert W. Sheldon, Winnetka, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/527,952

(22) Filed: Jul. 31, 2019

(65) Prior Publication Data

US 2019/0350323 A1 Nov. 21, 2019

Related U.S. Application Data

(63) Continuation of application No. 15/863,413, filed on Jan. 5, 2018, now Pat. No. 10,492,577.

(51) Int. Cl.

| | |
|---|---|
| ***A45B 9/00*** | (2006.01) |
| ***A45B 9/02*** | (2006.01) |
| ***A45B 9/04*** | (2006.01) |

(52) U.S. Cl.

CPC ..... *A45B 9/00* (2013.01); *A45B 9/02* (2013.01); *A45B 9/04* (2013.01);

(Continued)

(58) Field of Classification Search

CPC .... A45B 9/00; A45B 9/02; A45B 9/04; A45B 2009/005; A45B 2009/007;

(Continued)

(56) References Cited

U.S. PATENT DOCUMENTS 911,636 A * 2/1909 Whitlock ..... A45B 25/143 135/22
3,516,697 A * 6/1970 Hahn ..... F16B 7/182 403/118

(Continued)

FOREIGN PATENT DOCUMENTS

KR 20140102917 A * 8/2014 ..... A63B 29/08

*Primary Examiner* — David R Dunn
*Assistant Examiner* — Danielle Jackson
(74) *Attorney, Agent, or Firm* — Fitch, Even, Tabin & Flannery LLP

(57) ABSTRACT

Disclosed is a hinged cane to assist in user mobility. The cane comprises an upper section and a lower section and a hinged mechanism that connects the upper and lower sections. The hinged mechanism comprises a lower block and an upper block and a hinge coupler pivotally connected to the lower block and to the upper block. This configuration enables the lower section to be moved from a use position over a range of travel into a fully folded position. The cane includes a catch mechanism for releasably securing the upper section to the lower section when in the use position. The cane may include a foot that has a relatively more pliable skirt and a relatively less pliable central nub to assist in maintaining the natural walking motion of the user.

16 Claims, 9 Drawing Sheets

(52) U.S. Cl.
CPC ... *A45B 2009/005* (2013.01); *A45B 2009/007* (2013.01); *A45B 2200/05* (2013.01)

(58) Field of Classification Search
CPC ..... A45B 2200/055; A45B 3/12; A45B 19/08; A61H 3/00; A61H 3/02; A61H 3/0288; A61H 2201/0161; F16M 11/38; F16M 11/26
USPC ..... 135/65–66, 68, 72, 74–75, 77, 82, 84; 248/155.4–155.5, 188.6; 403/109.1–109.3, 100, 112–113, 116
See application file for complete search history.

(56) References Cited

U.S. PATENT DOCUMENTS 4,437,480 A * 3/1984 Husa ..... A61H 3/02 135/74
4,527,579 A * 7/1985 Knotter ..... A45B 9/00 135/74
5,139,283 A * 8/1992 Dow ..... A63C 11/221 135/72
5,771,910 A * 6/1998 Kluttz ..... A61H 3/02 135/68
5,788,608 A * 8/1998 Wilkinson ..... A63B 21/0724 482/51
6,131,593 A * 10/2000 Greene ..... A45B 9/04 135/77
7,003,849 B2 * 2/2006 Cohen ..... A63C 11/221 16/232
7,434,592 B2 * 10/2008 Larson ..... A61H 3/02 135/72
7,841,353 B2 * 11/2010 Lee ..... A45B 9/00 135/74
8,985,130 B2 * 3/2015 Howarth ..... A45B 9/00 135/114
9,456,671 B2 * 10/2016 Crowhurst ..... A45B 9/04
10,137,051 B2 * 11/2018 Ritter ..... A61H 3/0288
2005/0091792 A1 * 5/2005 Cohen ..... A63C 11/221 16/232
2015/0374082 A1 * 12/2015 Austin ..... A45B 9/04 135/77
2016/0262506 A1 * 9/2016 Sacks ..... A45B 1/04

* cited by examiner

HINGED WALKING CANE

TECHNICAL FIELD

The disclosure is in the field of mobility devices, and in particular embodiments, relates to a walking cane.

BACKGROUND

Innumerable varieties of walking canes have been described in the prior art. Known canes range in design from simple walking sticks to more complex collapsible or designs. Recently, a number of folding canes have been introduced. It can be challenging to prepare a folding cane that will have a reliable folding mechanism that can support the user reliably when in the unfolded position and that is easy to fold into a folded position. A folding cane must be sturdy, and, because the cane is intended for use by elderly or infirm users, a walking cane desirably should be sturdy when assembled, should not be subject to wobbling, and should not exhibit much give or "play" when assembled. Desirably, a walking cane should have an ergonomically acceptable handle, and, in particularly desirable embodiments, a cane should be self-supporting such that the cane will remain upright when rested on a level surface. In this latter regard, while a number of mechanisms are known for making a walking cane self-supporting, it is believed that some prior mechanisms can slightly impede the user's natural walking motion when in use.

It has now been found that a hinged cane may comprise an upper section and a lower section and a hinged mechanism connecting the upper and lower sections. The hinged mechanism may comprise a lower block disposed within an upper region of the lower section, and an upper block disposed within a lower region of the upper section, and a hinged coupler that is pivotally connected to each of the lower block and the upper block. This structure enables the lower section to be moved from a use position wherein the lower section is axially aligned relative to the upper section over a range of travel into a folded position. Either the lower block or the upper block is retractable within its respective upper or lower section, such that, when the lower and upper sections are axially aligned, the lower block may be moved relatively towards the upper block as this block retracts. The cane includes a catch mechanism that releasably secures the upper section to the lower section once the upper and lower section have been moved into the fully locked use position. Preferably, the device has several other features, as detailed hereinbelow.

DETAILED DESCRIPTION

Figure 1:
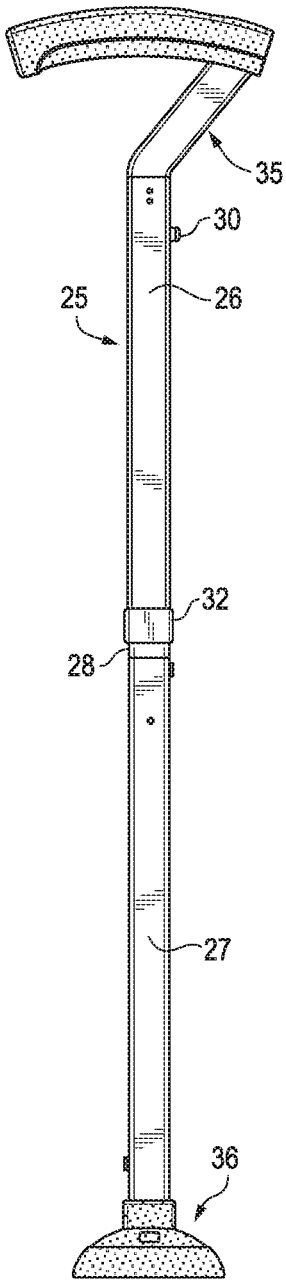
FIG. 1 is a front elevational view of a walking cane in accordance with one embodiment of the disclosure illustrating the cane in the use position.
Figure 2:
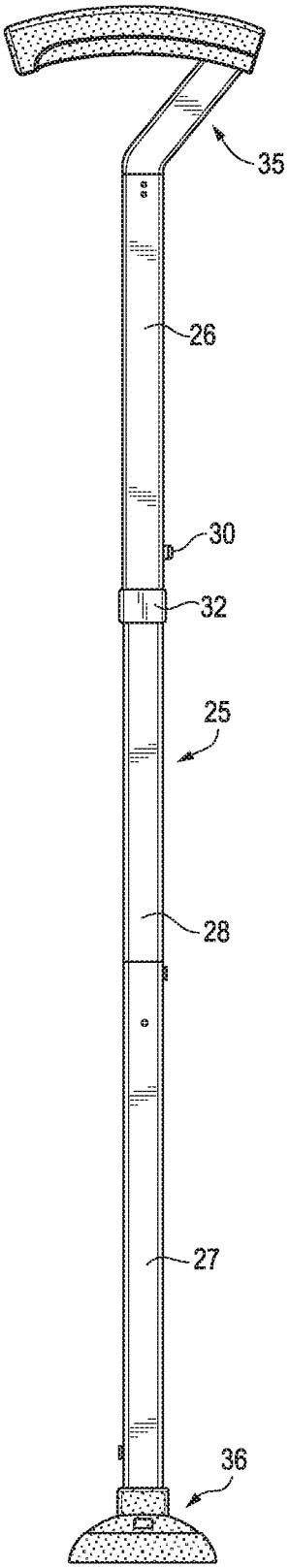
FIG. 2 is a front elevational view of the walking cane shown in FIG. 1, showing the cane in the use position.
Figure 3:
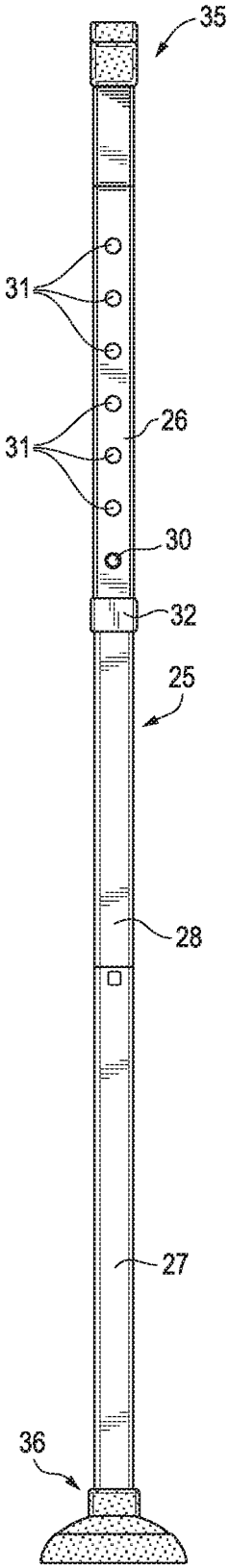
FIG. 3 is a first side elevational view of the cane when in the use position as depicted in FIG. 2.

With reference to FIGS. 1-3, the cane 25 includes an upper section 26, a lower section 27, and, as illustrated, an optional intermediate section 28 (visible especially in FIGS. 2 and 3). The intermediate section 28 is axially retractable within the upper section 26. As per conventional such canes, the intermediate section 28 includes a spring-loaded button 30 for engagement with a plurality of holes 31 in the upper section 26 to enable adjustment of the height of the cane. The intermediate section is captured within the lower section by retaining collar 32, as is conventional. In practice, the parts may be reversed such that the intermediate section is disposed instead within the lower section. FIGS. 1-3 further illustrate the handle 35 which is disposed at the uppermost part of the upper section 26, and a foot 36, which is disposed at the lowermost part of the lower section 22.

Figure 4:
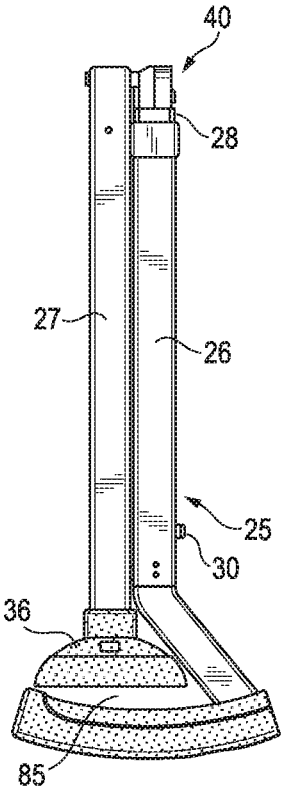
FIG. 4 is a front elevational view of the walking cane depicted in the previous figures, showing the cane in a folded storage position.
Figure 5:
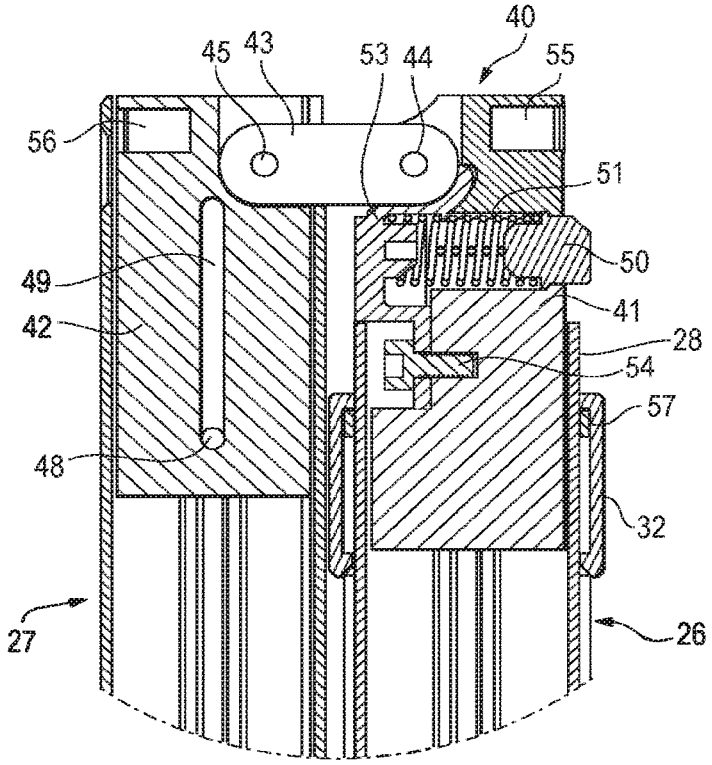
FIG. 5 is an enlarged cross-sectional view taken in the area of the hinge mechanism of the illustrated cane, shown when the cane is in the folded storage position.

As seen in FIGS. 4 and 5, the cane may be folded about a hinge mechanism 40 which is desirable for storage or retail display of the cane 25. With reference to FIG. 5, the illustrated hinge mechanism 40 comprises an upper block 41 and a lower block 42, and a hinge coupler 43 with pivot pins 44, 45 that allow for pivoting of the upper and lower sections 26, 27, respectively. The lower block 42 is movable over an axial range of travel within the lower section 27 which is tubular at least in its upper region and which may be tubular throughout. A pin 48 coupled to the lower section 27 and slot 49 in the lower block 42 define a range of travel for the lower block 42. As seen in FIG. 5, the upper block 41 includes a spring-loaded catch button 50 which is biased by a spring 51 that is secured by a retention plate 53 and screw 54. The hinge mechanism further includes a magnet 55 disposed within or as the terminal surface of the upper block 41 and a corresponding opposing magnet 56 disposed in or as the terminal surface of the lower block 42. In practice, the positions of these may be reversed, and one of the magnets may be replaced by a block of metal. Also shown in FIG. 5 is a bushing 57 that assists in securing the upper section 26 to the collar 32.

Figure 7:
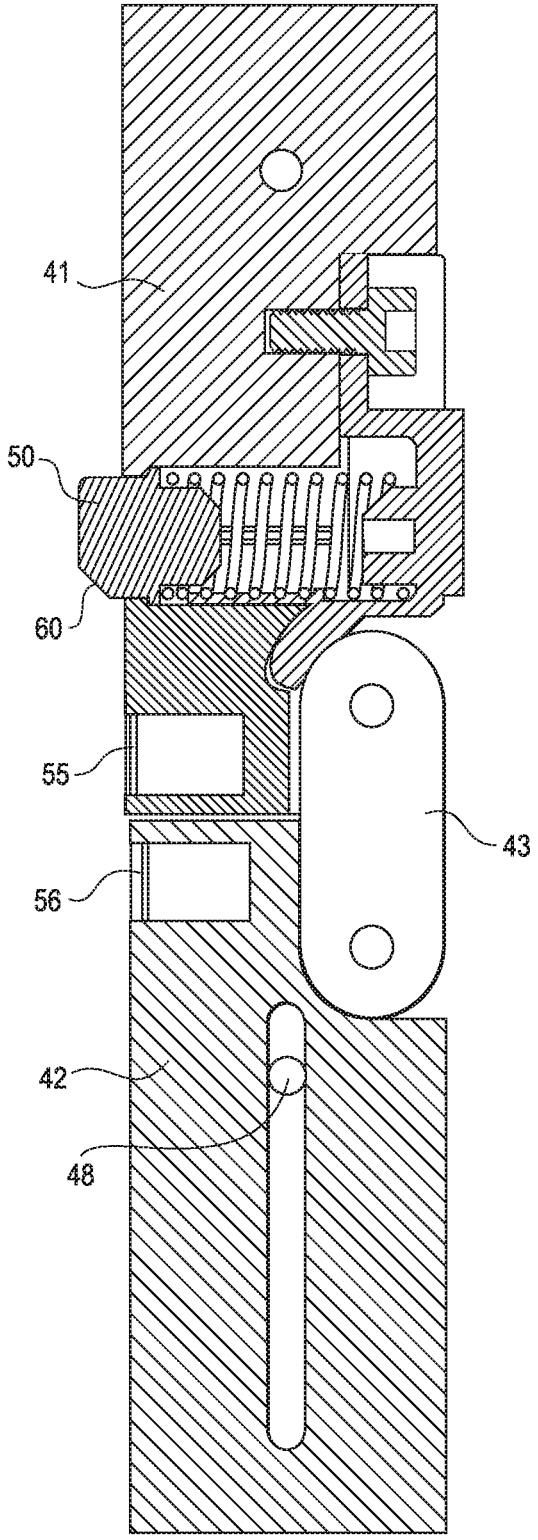
FIG. 7 is a cross-sectional view of taken in the area of the hinge mechanism as in FIG. 5, but shown when the cane is in the process of unfolding the cane.
Figure 8:
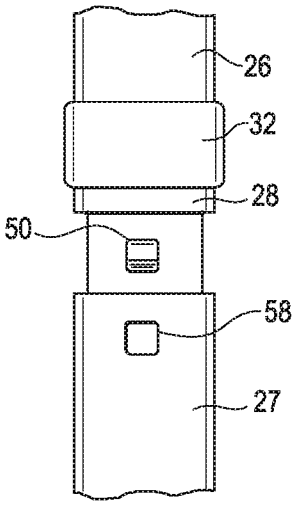
FIG. 8 is a side elevational view of a portion of the cane when in the position shown in FIG. 7.
Figure 9:
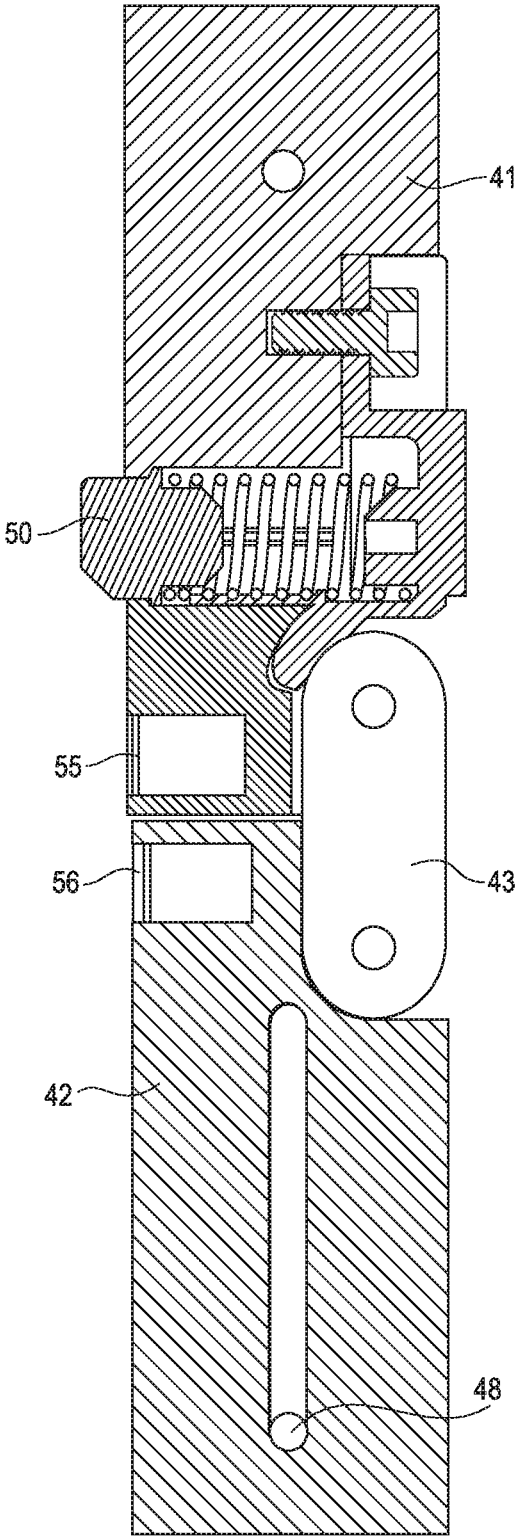
FIG. 9 is a cross-sectional view of taken in the area of the hinge mechanism as in FIGS. 5 and 7, but shown when the cane is in the use position.
Figure 10:
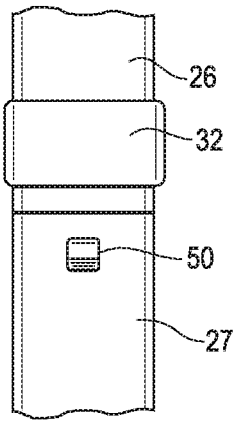
FIG. 10 is a side elevational view of a portion of the cane as shown in FIG. 9.

When it is desired to move the cane from a folded position to a use position, the lower section is pivoted relative to the upper section to bring the upper section and lower section into axial alignment, as seen in FIGS. 7 and 8. When moved into this position, the magnets or magnets and metal surface, will engage one another to cause a positive "click" to tactically or audibly alert the user that the upper and lower blocks are in alignment. At this point, the user axially moves the upper section relative to the lower section until the catch button 50 engages opening 58 in the lower section 27, as seen in FIGS. 8, 9 and 10. The catch button 50 may have a beveled edge 60 to enable the user more easily to slide the lower section over the catch button 50. As seen in FIGS. 9 and 10, the lower block 42 has retracted into the lower section 27, as is evident from the position of pin 48 within slot 49 in FIG. 9.

When it is desired to move the cane from back into a folded, storage position, the steps are simply reversed. By manually depressing the catch button 50, the user is able to separate the upper and lower sections and then return the upper and lower sections to the position shown in FIG. 4.

Figure 6:
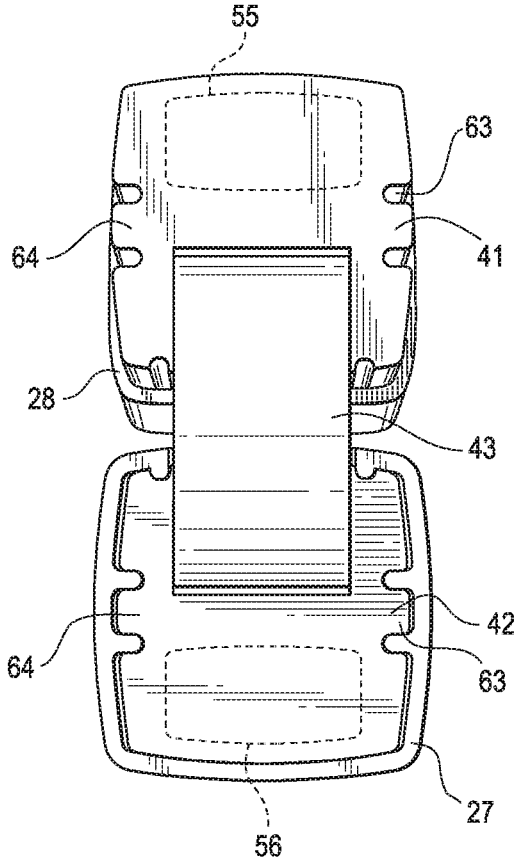
FIG. 6 is a top plan view of the cane when in the position shown in FIG. 6.
Figure 11:
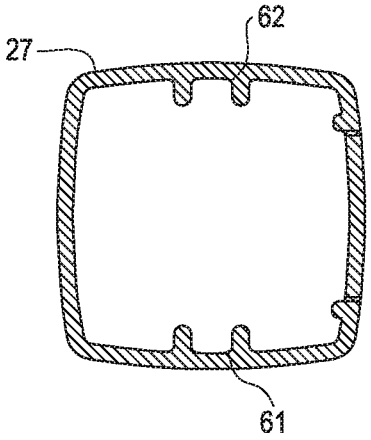
FIG. 11 is a cross-sectional view of the tubular structure that makes up the lower section of the illustrated cane.

Some prior foldable canes have tubular sections with a round cross-section, which can allow the various sections of the cane to rotate relative to one another when the cane is assembled for use. This is believed to allow for some play in the interconnected parts, thus leading to a looser "feel" for the user. Although rounded configurations are possible in connection with the present invention, in the illustrated cane, the upper and lower sections and block portions are configured to inhibit rotation of the upper section relative to the lower section when the cane is in the use position. As illustrated, the lower section 22 and the intermediate section 28, which is part of the upper section 26 in the illustrated embodiment, each have a generally square cross-section. These sections also are configured with slotted portions 61, 62 shown in FIG. 11 for the lower section 27, it being understood that the upper section is configured identically. Splined portions 63 on the blocks 64 (see FIG. 6) slide within these slot portions. Although this splined and slotted arrangement allows the upper and lower sections to slide axially relative to one another, rotation of the upper section and the lower section relative to one another is firmly inhibited. In practice, the positions of the slotted and splined positions may be reversed.

Figure 12:
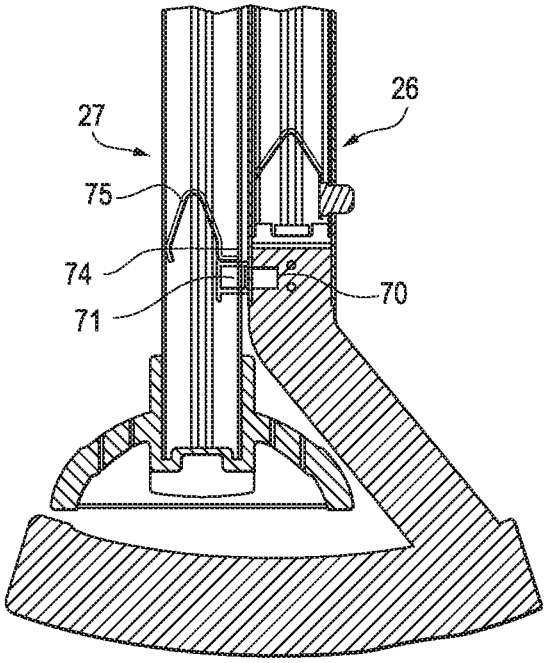
FIG. 12 is a cross-sectional view of portions of the upper and lower sections of the cane when in the folded position.

With reference now to FIG. 12, the upper section 26 includes a magnet 70, which, in the illustrated embodiment, is disposed within or forms a terminal region of the handle 35. The magnet 70 engages a corresponding magnet or metal surface 71 that is disposed within or forms a terminal region of on the lower section 27. Again, in practice, the position of the magnet and corresponding magnet or metal may be reversed. This mechanism creates a magnetic coupling of the upper and lower sections, such that, when the lower section is moved relative to the upper section into the folded position, the magnetic coupling thus created will cause an audible or tactile confirmation that the cane is fully folded. Additionally, the magnetic coupling cane will resist unfolding to some extent for retail display. Desirably, the lower section may include a protruding cap 74 that is retained via internal clip 75 within the lower section 27. The collar 32 is of a slightly greater dimension than the upper and lower sections, which in the illustrated embodiment have identical length and width. The protruding cap 74 positions the corresponding magnet or metal 71 slightly away from the exterior wall of the lower section 27 and at a dimension that is similar to that of the collar 32. Via this configuration, the lower section and upper section will be generally parallel relative to one another when in the folded position.

Figure 13:
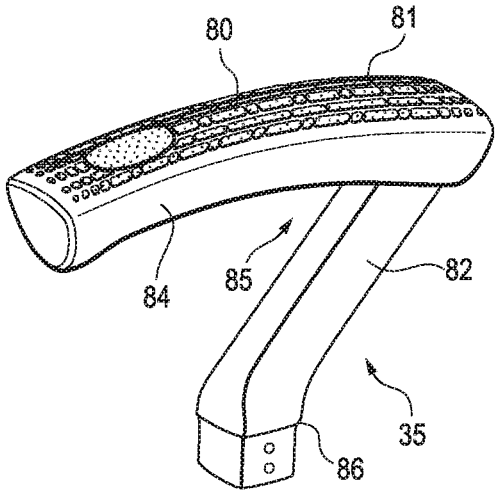
FIG. 13 is a perspective view of the user gripping handle of the cane.
Figure 14:
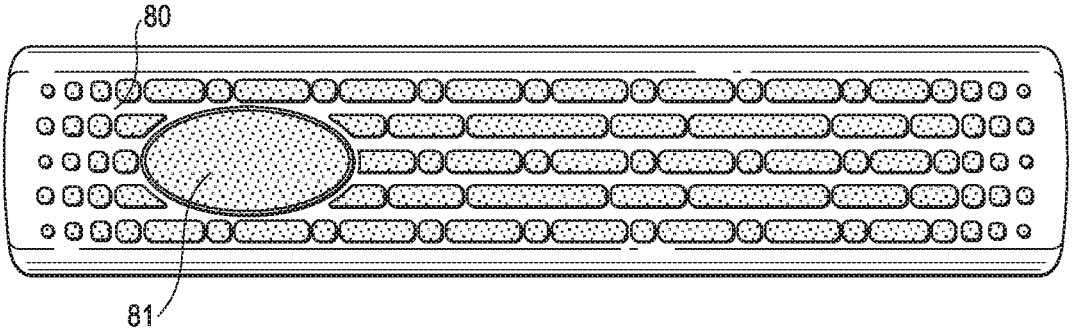
FIG. 14 is a top plan view of the user gripping handle depicted in FIG. 13.
Figure 15:
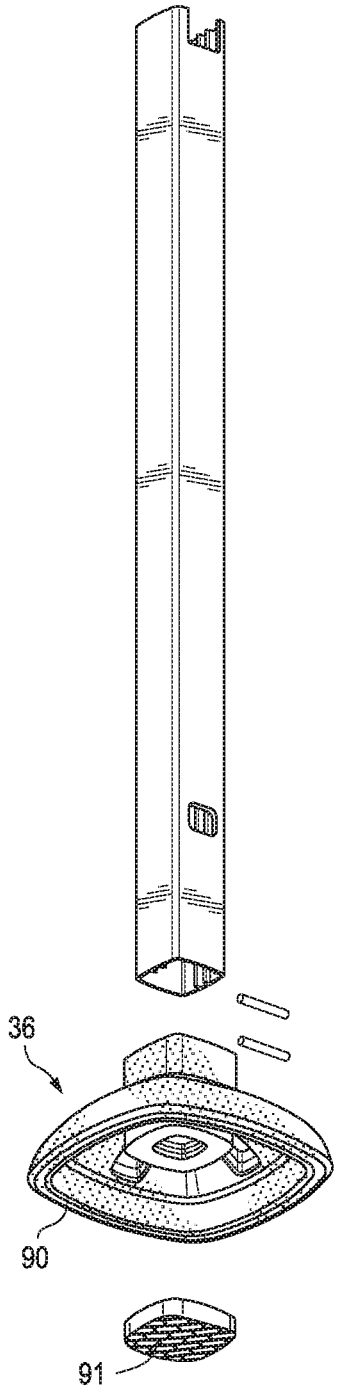
FIG. 15 is an exploded view, taken in perspective, of the lower section and the foot of the illustrated cane.
Figure 16:
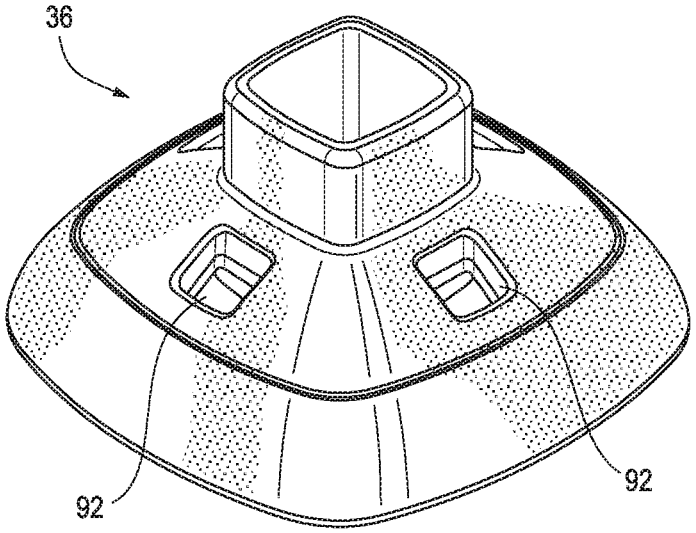
FIG. 16 is a perspective view of the foot illustrated in FIG. 15.
Figure 17:
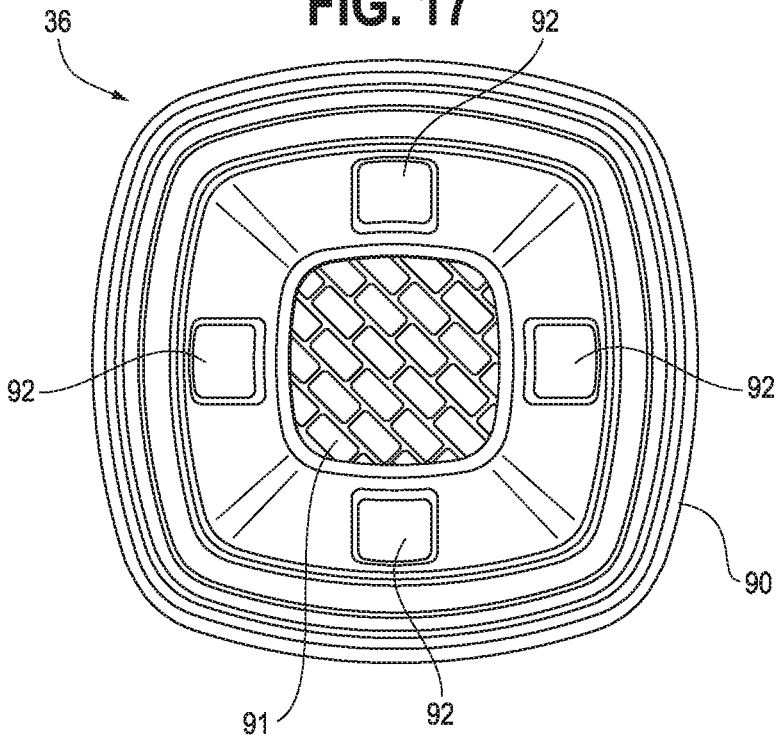
FIG. 17 is a bottom plan view of the foot illustrated in FIGS. 15 and 16.

With reference now to FIGS. 13 and 14, the handle 35 may have a textured surface 80 disposed at a top surface thereof for user traction. The upper surface may further include a thumb rest region 81 that is not textured for comfort and to assist in proper hand placement. The handle 35 may be formed integrally with the upper section 26, but may also be provided as a separate piece, as illustrated, sized to fit within a tubular region of the upper section 26 and provided with a small shoulder 86 to enable the handle and upper section to meet at a flush joint. The handle 35 has an angled region 82 and a grip region 84 that define a crook 85. Returning to FIG. 4, the crook 85 is preferably sized relative to the foot 36 such that the foot 36 nests within the crook 85 when the cane is in the folded position. This again allows the upper and lower sections 26,27 to rest parallel to one another when the cane is in the folded position to allow ease of storage or a cleaner retail display, With reference to FIGS. 15-17, the foot 36 is of sufficient dimension to enable the cane to be self-supporting when placed on a level surface. The foot 36 comprises a skirt 90 and a central 91, preferably each in the shape as illustrated. The skirt 90 is preferably of a relatively more pliable material than the nub 91, which is preferably is composed of a relatively pliable material. The nub 91 may be affixed to the skirt 90 via welding or adhesive. Via such construction, the skirt 90 will yield somewhat more readily than the central nub 91 during the ordinary walking motion of the user, thereby enabling the cane to pivot relative to the ground or floor when the user is walking. This construction is believed to facilitate in maintaining the natural walking motion of the user. In other embodiments, a relatively less pliable nub may be co-molded with a relatively more pliable skirt in the same mold, such that the nub and skirt are interchangeable. The skirt may be provided with apertures 92, as shown, which provide somewhat more "give" to the skirt.

The cane may be formed of parts that are conventional. The upper and lower sections may be formed from extruded aluminum tubing. The skirt and nub may be formed from thermoplastic rubber. The block portions may be composed of polyethylene or another suitable plastic, and the handle may be formed from plastic or a hard rubber material.

It is thus seen that a hinged walking cane may be provided in accordance with the above disclosure. Notably, the structure shown herein has been described with regard to a walking cane, but the disclosed construction may be used in one or more of its various aspects in connection with walkers, rollators, crutches, and other mobility devices.

All methods described herein can be performed in any suitable order unless otherwise indicated herein or otherwise clearly contradicted by context. The use of any and all examples, or language describing an example (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A hinged cane comprising an upper section and a lower section, and a hinge mechanism connecting said upper and lower sections;

said upper section having a generally tubular region at least in a lower region of said upper section, and having an operator gripping handle disposed at an upper region of said upper section;

said lower section having a generally tubular region at least in an upper region of said lower section, and having a foot disposed at a lower region of said lower section;

said hinge mechanism comprising a retractable block having a lower block portion disposed within said upper region of said lower section and an upper block portion disposed within said lower region of said upper section, and a hinge coupler, said hinge coupler being pivotally connected to said lower block portion and also being pivotally connected to said upper block portion to enable said lower section to be moved from a use position where said lower section is axially aligned relative to said upper section over a range of travel into a folded position;

one of said lower block portion and said upper block portion being retractable within its respective section;

said cane including a catch mechanism for releasably securing said upper section to said lower section, whereby a user may secure the lower section to the upper section by moving the lower section into axial alignment with the upper section causing an upper surface of said lower block portion to engage a lower surface of said upper block portion, and then axially translating said lower section relatively towards said upper section to cause retraction of said retractable block, said catch mechanism engaging when said lower section has been moved into a catch position relative to said upper block portion, said upper and lower block portions remaining in engagement when said catch mechanism is engaged.

2. The hinged cane according to claim 1, said lower block portion being retractable within a tubular region of the lower section and said upper block portion being fixed relative to the upper section.

3. The hinged cane according to claim 1, said catch mechanism comprising a spring-loaded catch button mounted on said upper block portion, said catch button engaging a catch opening in said generally tubular region of said lower section.

4. The hinged cane according to claim 1, said generally tubular regions of said upper and lower sections having a cross-sectional profile that inhibits relative radial movement of said upper and lower sections when said lower section is secured to said upper section.

5. The hinged cane according to claim 4, said generally tubular regions having a splined or slotted interior profile for engagement with a corresponding slotted or splined profile of said upper and lower block portions.

6. The hinged cane according to claim 1, one of said upper and lower block portions being provided with a magnet and the other of said upper and lower block portions being provided with a corresponding magnet or metal to enable magnetic coupling of said upper and lower block portions when said upper section is brought into axial alignment with said lower section.

7. The hinged cane according to claim 1, one of said upper section and said lower section including a magnet and the other of said upper section and said lower section including a corresponding magnet or metal, said magnet and said corresponding magnet or metal being axially positioned to engage one another and to magnetically couple said upper section and said lower section to one another when said cane is in a folded position.

8. The hinged cane according to claim 1, one of said upper and lower sections being provided with an intermediate section, said intermediate section being retractable therewithin, the respective upper or lower section being provided with a plurality of height adjustment holes, the intermediate section including a height adjustment catch button engageable individually with said height adjustment holes to permit adjustment of the height of the cane.

9. The hinged cane according to claim 1, said foot having a sufficient base area to permit said cane to be self-supporting on a flat surface.

10. The hinged cane according to claim 9, said operator gripping handle having a crook, said crook accommodating nesting of said foot when said cane is in a folded position.

11. The hinged cane according to claim 9, said foot comprising a relatively more pliable skirt and a relatively less pliable central nub.

12. A hinged cane comprising an upper section and a lower section, and a hinge mechanism connecting said upper and lower sections;

said upper section having a generally tubular region at least in a lower region of said upper section, and having an operator gripping handle disposed at an upper region of said upper section;

an intermediate section that is retractable within said upper section, said intermediate section being provided with a plurality of height adjustment holes, said upper section being provided with a height adjustment catch button engageable individually with said height adjustment holes to permit adjustment of the height of the cane;

said lower section having a generally tubular region at least in an upper region of said lower section, and having a foot disposed at a lower region of said lower section;

said hinge mechanism comprising a retractable block having a lower block portion disposed within said upper region of said lower section and an upper block portion disposed within said lower region of said upper section, and a hinge coupler, said hinge coupler being pivotally connected to said lower block portion and also being pivotally connected to said upper block portion to enable said lower section to be moved into a use position where said lower section is axially aligned relative to said upper section over a range of travel into a folded position;

said lower block portion being retractable within said lower section;

said generally tubular regions of said upper and lower sections having a splined or slotted interior profile for engagement with a corresponding slotted or splined profile of said upper and lower block portions;

one of said upper and lower block portions being provided with a magnet and the other of said upper and lower block portions being provided with a corresponding magnet or metal to enable magnetic coupling of said upper and lower block portions when said upper section is brought into axial alignment with said lower section;

said cane including a catch mechanism for releasably securing said upper section to said lower section, said catch mechanism comprising a spring-loaded catch button mounted on said upper block portion, said catch button engaging a catch opening in said generally tubular region of said lower section;

whereby a user may secure the lower section to the upper section by moving the lower section into axial alignment with the upper section and causing said lower block portion to engage said upper block portion, and axially translating said lower section relatively towards said upper section to cause retraction of said retractable block relative to said lower section, said catch mechanism engaging when said lower section has been moved into a catch position relative to said upper block portion.

13. The hinged cane according to claim 12, one of said upper region of said upper section and said lower region of said lower section including a closing magnet and the other of said upper region of said upper section and said lower region of said lower section including a corresponding closing magnet or closing metal, said closing magnet and said corresponding closing magnet or closing metal being axially positioned to engage one another and to magnetically couple said upper section and said lower section to one another when said cane is in a folded position.

14. The hinged cane according to claim 12, said foot having a sufficient base area to permit said cane to be self-supporting on a flat surface.

15. The hinged cane according to claim 14, said operator gripping handle having a crook, said crook accommodating nesting of said foot when said cane is in a folded position.

16. The hinged cane according to claim 12, said foot comprising a relatively more pliable skirt and a relatively less pliable central nub.

* * * * *